US008357641B2

(12) United States Patent
Paquette et al.

(10) Patent No.: US 8,357,641 B2
(45) Date of Patent: Jan. 22, 2013

(54) FOOD GRADE COMPRESSOR/VACUUM PUMP CLEANER

(75) Inventors: Troy F. Paquette, Hartland, WI (US); Eric J. Peter, Elm Grove, WI (US)

(73) Assignee: Jax Inc., Menomonee Falls, WI (US)

( * ) Notice: Subject to any disclaimer, the term of this patent is extended or adjusted under 35 U.S.C. 154(b) by 182 days.

(21) Appl. No.: 12/575,359

(22) Filed: Oct. 7, 2009

(65) Prior Publication Data

US 2010/0093570 A1 Apr. 15, 2010

Related U.S. Application Data

(60) Provisional application No. 61/195,363, filed on Oct. 7, 2008.

(51) Int. Cl.
*C10M 101/04* (2006.01)
*C10M 169/04* (2006.01)

(52) U.S. Cl. ..... 508/208; 508/486; 508/491

(58) Field of Classification Search ..... 508/208, 508/507, 486, 491
See application file for complete search history.

(56) References Cited

U.S. PATENT DOCUMENTS

| | | | | |
|---|---|---|---|---|
| 4,737,297 | A * | 4/1988 | Yoshida et al. | 508/110 |
| 6,267,907 | B1 * | 7/2001 | Tolfa et al. | 252/68 |
| 6,756,346 | B1 * | 6/2004 | Baba et al. | 508/433 |
| 2011/0082061 | A1 | 4/2011 | Carey et al. | |

OTHER PUBLICATIONS

21 CFR; part 170-199; pp. 415-416 (Apr. 1, 2008).

* cited by examiner

*Primary Examiner* — Walter D Griffin
*Assistant Examiner* — Francis C Campanell
(74) *Attorney, Agent, or Firm* — Hansen IP Law PLLC

(57) ABSTRACT

Embodiments of the invention provide a food grade cleaning oil, such as one of synthetic or mineral oil origin, which can be used for the cleaning, flushing, and lubrication of compressors and vacuum pumps. The cleaner composition can include alkylated aromatics, such as naphthalenes. The cleaner composition can be compounded with additives including one or more of antioxidants, corrosion inhibitors, antiwear additives, metal passivators, and anti foam agents that are cleared for incidental food contact.

7 Claims, No Drawings

FOOD GRADE COMPRESSOR/VACUUM PUMP CLEANER

RELATED APPLICATIONS

This application claims priority under 35 U.S.C. §119 to U.S. Provisional Patent Application No. 61/195,363 filed on Oct. 7, 2008, the entire contents of which is incorporated herein by reference.

BACKGROUND

This invention relates to lubricants and, more particularly, to food grade lubricating oils which are especially useful as cleaning and flushing agents for compressor or vacuum pump equipment utilized in the food service industry.

The equipment used in the food processing industry varies by segment with the three leading segments being meat and poultry, beverages, and dairy. While the equipment varies from segment to segment, the majority of manufacturing operations require significant amounts of compressed air. Due to the importance of ensuring and maintaining safeguards and standards of quality for food products, the food industry must comply with the rules and regulations set forth by the United States Department of Agriculture (USDA), originally under The Food Safety and Inspection Service (FSIS), as part of the Federal Food, Drug and Cosmetic Act (FFDCA), which holds responsibility for all programs for the inspection, grading, and standardization of meat, poultry, eggs, dairy products, fruits, and vegetables.

Under the FFDCA, specifically section 21 CFR 178.3570, lubricants which are susceptible to incidental food contact are considered indirect food additives under USDA regulations. Lubricants classified as "H1" are authorized for incidental food contact. H1 authorized lubricating oil and the term "food grade" will be used interchangeably herein and in the appended claims.

Several market factors accentuate the need for a superior food grade cleaning/lubricating oil. Some manufacturers prefer to use only H1 authorized oils to avoid the possibility of noncompliance. Reducing contamination risks and inventory carrying costs associated with stocking multiple inventories of varying viscosity/FDA approval level oils also provides an economic incentive for exclusive use of H1 authorized oils. Furthermore, other firms, reliant upon company image as a marketing resource, may elect to take the conservative approach to health and safety issues and utilize only H1 authorized oils. All of these concerns are addressed by the exclusive use of H1 authorized oils.

In addition to meeting the requirements for safety set by federal regulatory agencies, the product must be an effective lubricant. Lubricating oils for food processing plants should lubricate machine parts, resist viscosity change, resist oxidation, protect against rusting and corrosion, provide wear protection, prevent foaming, and resist the formation of sludge in service. The product should also perform effectively at various lubrication regimes ranging from hydrodynamic thick film regimes to boundary thin film regimes.

The oxidation, thermal, and hydrolytic stability characteristics of lubricating oil help predict how effectively an oil will maintain its lubricating properties over time and resist sludge formation. Hydrocarbon oils are partially oxidized when contacted with oxygen at elevated temperatures for prolonged periods of time. The oxidation process produces acidic bodies within the lubricating oil which are corrosive to metals often present in food processing equipment. Many metals present in food processing equipment and in contact with both the oil and the air are effective oxidation catalysts which further increase the rate of oxidation. Oxidation products contribute to the formation of sludge which can clog valves, plug filters, and result in the overall breakdown of the viscosity characteristics of the lubricant. Under some circumstances, sludge formation can result in plugging, complete loss of oil system flow, and failure or damage to machinery.

The thermal and hydrolytic stability characteristics of lubricating oil reflect primarily on the stability of the lubricating oil additive package. The stability criteria monitor sludge formation, viscosity change, acidity change, and the corrosion tendencies of the oil. Hydrolytic stability assesses these characteristics in the presence of water. Inferior stability characteristics result in the lubricating oil losing lubricating properties over time and precipitating sludge.

SUMMARY

In light of the problems discussed above, it is desirable to provide an improved food grade cleaning oil. Some embodiments of the invention provide a high performance food grade oil, such as one of synthetic or mineral oil origin, that can effectively clean, flush, and lubricate compressors and vacuum pumps. The lubricant cleaner composition can include alkylated aromatics, such as naphthalenes. The composition can be compounded with additives including one or more of antioxidants, corrosion inhibitors, antiwear additives, metal passivators, and anti foam agents that are cleared for incidental food contact.

DETAILED DESCRIPTION

Before any embodiments of the invention are explained in detail, it is to be understood that the invention is not limited in its application to the details set forth in the following description. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

The following discussion is presented to enable a person skilled in the art to make and use embodiments of the invention. Various modifications to the embodiments will be readily apparent to those skilled in the art, and the generic principles herein can be applied to other embodiments and applications without departing from embodiments of the invention. Thus, embodiments of the invention are not intended to be limited to embodiments described, but are to be accorded the widest scope consistent with the principles and features disclosed herein. Skilled artisans will recognize the examples provided herein have many useful alternatives and fall within the scope of embodiments of the invention.

Some embodiments of the invention provide a high performance food grade oil, such as one of synthetic or mineral oil origin, that can effectively clean, flush, and lubricate compressors and vacuum pumps utilized in the food processing industry. The food grade cleaning oil of some embodiments can also provide superior sludge and varnish elimination, rust and corrosion protection, and foam resistance.

In some embodiments, the cleaning oil can include a long chain alkylated aromatic base fluid, such as an alkylnaphthalene. The food contact authorized long chain alkylated aromatic (i.e., alkylated naphthalene) can have a viscosity greater than about 25 centistokes (cSt) measured at about 40 degrees Celsius. The alkylnaphthalene can be compounded with an additive package including effective amounts of antioxidants, rust and corrosion inhibitors, metal passivators or deactivators, lubricity additives, anti-wear additives, dispersants, antifoam agents, and/or other additives to produce a superior cleaner and lubricant for compressors or vacuum pumps. The cleaning oil can provide dispersancy and solvency for the cleaning and elimination of varnish, thermal and oxidative by-products, and production materials ingested in the equipment while performing lubricating functions that provide significant performance improvements in oxidation stability, elastomer compatibility, hydrolytic stability, improved wear protection, corrosion inhibition and varnish control.

The cleaning oil of some embodiments meets and exceeds all requirements necessary for incidental food contact (H1) approval as determined by the FFDCA. The cleaning oil of some embodiments can include an incidental food contact authorized synthetic cleaning fluid for use in compressor and vacuum pump applications that conforms to the requirements for incidental food contact as defined under 21 CFR 178.3570.

Current incidental food contact cleaners utilized in this equipment provide inferior varnish control. Some embodiments of the invention can substantially reduce or eliminate deposits and varnish and significantly enhance equipment life and operation. The cleaning oil can provide significant performs improvements in oxidation stability, thermal stability, and hydrolytic stability, improved wear protection, corrosion inhibition and varnish control. It can also provide superior protection from sludging, rust and corrosion protection, and foam resistance. In some embodiments, to achieve these objectives, the high performance food grade cleaner can include a synthetic base fluid and a sufficient amount of an additive package to impart the necessary performance characteristics to the cleaning/lubricating fluid.

Base Oil

In some embodiments, the base oils for use in the synthetic food grade compressor/vacuum pump cleaner/lubricant can include FFDCA authorized long chain alkylated aromatics, such as alkylnaphthalenes, or alkylated naphthalenes, as defined in U.S. Pat. No. 5,602,086, the entire contents of which is incorporated herein by reference.

The cleaner/lubricant compositions when used in compressors and vacuum pumps can be selected to have a viscosity in the range of about 15 centistokes to about 150 centistokes at about 40 degrees Celsius and a pour point in the range of 0 degrees Celsius to about minus 40 degrees Celsius.

Additive Technology

In some embodiments, the cleaner/lubricant compositions can include effective amounts of one or more of the following additives: antioxidants, corrosion inhibitors, metal deactivators, lubricity additives, dispersants, antifoam agents, and other such additives as may be desired.

Antioxidants

The antioxidant package for the cleaner/lubricant composition can include a combination of food grade phenolic and aminic antioxidants. The class of phenolic antioxidants which can be employed include food grade, oil-soluble, sterically hindered phenols and thio-phenols. Included within the definition of phenolic and thiophenolic antioxidants are sterically hindered phenolics such as hindered phenols and bis-phenols, hindered 4,4'-thiobisphenols, hindered 4-hydroxy- and 4-thiolbenozoic acid esters and dithio esters, and hindered bis(4-hydroxy- and 4-thiolbenzoic acid and dithio acid)alkylene esters. Examples of sterically hindered phenols include 2,6-di-tert-butyl-p-cresol, 2,6-di-tert-amyl-p-cresol, and 2-tert-butyl-6-tert-amyl-p-cresol.

A second group of hindered phenolic antioxidants are the hindered bisphenols. Examples of these compounds include 4,4'-methylene bis(2,6-bi-tert-butylphenol), 4,4'-dimethylene bis(2,6-di-tert-butyl phenol), 4,4'-trimethylene bis(2,2-di-tert-amyl phenol), hexamethylenebis(3,5-di-tert-butyl-4-hydroxyhydrocinnamate), tetrakis[methylene(3,5-di-tert-butyl-4-hydroxyhydro-cinnamate)]methane and 4,4'-trimethylene bis(2,6-di-tert-butyl phenol).

Additional hindered phenolic antioxidants utilized include a group of hindered thio bis-phenols (i.e., where the sulfur connected to another phenolic group). Examples of these compounds include 4,4'-thio bis(2,6-di-sec-butyl phenol), 4,4'-thio bis(2-tert-butyl-6-isopropyl phenol), thiodiethylenebis(3,5-di-tert-butyl-4-hydroxyhydrocinnamate), and 4,4'-thio bis(2-methyl-6-t-butyl phenol).

A fourth group of hindered phenolic antioxidants are the alkoxy phenols, Examples of these compounds include butylated hydroxy anisole (BHA) and butylated hydroquinone.

Suitable food grade, oil-soluble aromatic amine antioxidants include phenyl-[alpha]- and/or phenyl-[beta]-naphthylamines, naphthyl phenyl amines, alkylated phenyl naphthyl amines, and alkylated diphenyl amines. Examples of aromatic amine antioxidants include, N-phenyl-ar-(1,1,3,3-tetramethylbutyl)-1-naphthalenamine, N-phenyl-alpha-naphthylamine, N-p-methyl-phenyl-alpha-naphthylamine, N-phenylbenzenamine, reaction products with 2,4,4-trimethylpentene and the diphenylamines such as disecbutyldiphenylamine, and dioctyldiphenylamine.

The phenolic and aromatic amine combination can range in ratio by weight from about 20:1 to about 1:20, although the preferred ratio ranges from about 4:1 to about 1:1. Treat rates range from about 0.25% to about 2.0% by weight of the cleaning/lubricating fluid. Oxidation stability performance is superior and fairly consistent over the preferred ratio range. Additional performance increase is made available by the utilization of tris(2,4-di-tert-butylphenyl)phosphite as a secondary peroxide decomposer.

Corrosion Inhibitors

The anti-rust additive package for the cleaner/lubricant composition can include a combination of food grade surface active anti-rust ingredients. Anti-rust lubricating additives which can be employed include food grade phosphoric acid, mono and dihexyl ester compounds with tetramethyl nonyl amines. Examples include phosphoric acid, mono- and diisooctyl esters, reacted with tert-alkyl and (C12-C14) primary amines and phosphoric acid, mono- and dihexyl esters compounded with tetramethylnonylamines and (C12-C14) alkyl amines.

Additional corrosion inhibition is provided by utilization of 2-(8-Heptadecenyl)-4,5-dihydro-1H-imidazole-1-ethanol alone or in synergistic combination with N-Methyl-N-(1-oxo-9-octadecenyl)glycine. In some embodiments, the food grade anti-rust additives can include about 0.05% to about 2.0% by weight of the cleaning/lubricating oil.

Additional performance benefits can be obtained by the addition of N,N-Bis(2-ethylhexyl)-ar-methyl-1H-benzotriazole-1-methanamine, a cuprous metal deactivator, at about 0.10% by weight of the cleaning/lubricating oil.

Anti-Wear Additives

Anti-wear additives for the cleaner/lubricant composition can include food grade oil-soluble sulfur and/or phosphorus containing compounds. Compounds meeting this criteria include triphenyl phosphorothionate, tri[2(or 4)-C9-10-branched alkylphenyl]phosphorothioate and phosphorothioic acid,O,O,O-triphenyl ester, tert-butyl derivatives, alone or in combination, including about 0.25% to about 0.5% by weight of the cleaning/lubricating fluid.

Anti-Foam

A dimethylpolysiloxane (viscosity greater than about 300 centistokes) for use in the cleaner/lubricant composition can provide antifoam performance at treat rates ranging from about 20 to about 100 parts per million (PPM).

In some embodiments, an effective amount of the foregoing additives for use in compressors or vacuum pumps is generally in the range from about 0.1 to about 3 weight percent for the antioxidants, about 0.05 to about 1.5 weight percent for the corrosion inhibitors and about 0.05 to about 0.1 weight percent for the metal deactivators. Antiwear additization can be generally in the range of about 0.25 to about 0.50 weight percent. These weight percentages are based on the total weight of the cleaning/lubricating fluid. More or less of the additives can be used depending upon the circumstances for which the final compositions are to be used.

The following examples illustrate the practice of specific embodiments of the invention and comparison cases. These examples should not be interpreted as limitations of the scope of this invention.

EXAMPLE 1

A food grade cleaning/flushing/lubricating fluid was prepared in a beaker by adding:

a) 93.4% by weight of an alkylated naphthalene with a viscosity of 109 cSt at 40 degrees Celsius;
b) 0.50% by weight of Hexamethylenebis(3,5-di-tert-butyl-4-hydroxyhydrocinnamate);
c) 0.50% by weight of N-phenylbenzenamine, reaction products with 2,4,4-trimethylpentene;
d) 0.50% by weight of Thiodiethylenebis(3,5-di-tert-butyl-4-hydroxyhydrocinnamate);
e) 0.50% by weight of Tetrakis[methylene(3,5-di-tert-butyl-4-hydroxyhydro-cinnamate)]methane;
f) 0.50% by weight of N-phenyl-ar-(1,1,3,3-tetramethylbutyl)-1-naphthalenamine;
g) 0.50% by weight of BHT (butylated hydroxyl toluene, 2,6-di-tert-butyl-p-cresol);
h) 0.50% by weight of BHA (butylated hydroxy anisole);
i) 0.50% by weight of phosphoric acid, mono- and diisooctyl esters, reacted with tert-alkyl and (C12-C14) primary amines;
j) 0.50% by weight of phosphoric acid, mono- and dihexyl esters compounded with tetramethylnonylamines and (C12-C14) alkyl amines;
k) 0.50% by weight of Triphenyl phosphorothionate;
l) 0.50% by weight of 2-(8-Heptadecenyl)-4,5-dihydro-1H-imidazole-1-ethanol;
m) 0.50% by weight of N-Methyl-N-(1-oxo-9-octadecenyl)glycine;
n) 0.10% by weight of N,N-Bis(2-ethylhexyl)-ar-methyl-1H-benzotriazole-1-methanamine; and
o) 40 Parts Per Million (PPM) of a dimethylpolysiloxane.

Viscometrics of the sample were:

| | |
|---|---|
| Viscosity 100 degrees Celsius | 12.4 centistokes (cSt); |
| Viscosity 40 degrees Celsius | 109 centistokes (cSt); and |
| Viscosity Index | 105. |

EXAMPLE 2

A food grade compressor fluid was prepared in a beaker by adding:

a) 64% by weight of an alkylated naphthalene with a viscosity of 29 cSt at 40 degrees Celsius and 29.4% by weight of an alkylated naphthalene with a viscosity of 109 cSt at 40 degrees Celsius;
b) 0.50% by weight of Hexamethylenebis(3,5-di-tert-butyl-4-hydroxyhydrocinnamate);
c) 0.50% by weight of N-phenylbenzenamine, reaction products with 2,4,4-trimethylpentene;
d) 0.50% by weight of Thiodiethylenebis(3,5-di-tert-butyl-4-hydroxyhydrocinnamate);
e) 0.50% by weight of Tetrakis[methylene(3,5-di-tert-butyl-4-hydroxyhydro-cinnamate)]methane;
f) 0.50% by weight of N-phenyl-ar-(1,1,3,3-tetramethylbutyl)-1-naphthalenamine;
g) 0.50% by weight of BHT (butylated hydroxyl toluene, 2,6-di-tert-butyl-p-cresol);
h) 0.50% by weight of BHA (butylated hydroxy anisole);
i) 0.50% by weight of phosphoric acid, mono- and diisooctyl esters, reacted with tert-alkyl and (C12-C14) primary amines;
j) 0.50% by weight of phosphoric acid, mono- and dihexyl esters compounded with tetramethylnonylamines and (C12-C14) alkyl amines;
k) 0.50% by weight of Tri[2(or 4)-C9-10-branched alkylphenyl]phosphorothioate;
l) 0.50% by weight of 2-(8-Heptadecenyl)-4,5-dihydro-1H-imidazole-1-ethanol;
m) 0.50% by weight of N-Methyl-N-(1-oxo-9-octadecenyl)glycine;
n) 0.10% by weight of N,N-Bis(2-ethylhexyl)-ar-methyl-1H-benzotriazole-1-methanamine; and
o) 40 Parts Per Million (PPM) of a dimethylpolysiloxane.

Viscometrics of the sample were:

| | |
|---|---|
| Viscosity 100 degrees Celsius | 6.7 centistokes (cSt); |
| Viscosity 40 degrees Celsius | 46.7 centistokes (cSt); and |
| Viscosity Index | 93. |

EXAMPLE 3

A food grade compressor fluid was prepared in a beaker by adding:

a) 83.4% by weight of an alkylated naphthalene with a viscosity of 29 cSt at 40 degrees Celsius and 10% by weight of an alkylated naphthalene with a viscosity of 109 cSt at 40 degrees Celsius;
b) 0.50% by weight of Hexamethylenebis(3,5-di-tert-butyl-4-hydroxyhydrocinnamate);
c) 0.50% by weight of N-phenylbenzenamine, reaction products with 2,4,4-trimethylpentene;
d) 0.50% by weight of Thiodiethylenebis(3,5-di-tert-butyl-4-hydroxyhydrocinnamate);
e) 0.50% by weight of Tetrakis[methylene(3,5-di-tert-butyl-4-hydroxyhydro-cinnamate)]methane;
f) 0.50% by weight of N-phenyl-ar-(1,1,3,3-tetramethylbutyl)-1-naphthalenamine;
g) 0.50% by weight of BHT (butylated hydroxyl toluene, 2,6-di-tert-butyl-p-cresol);
h) 0.50% by weight of BHA (butylated hydroxy anisole);

i) 0.50% by weight of phosphoric acid, mono- and diisooctyl esters, reacted with tert-alkyl and (C12-C14) primary amines;

j) 0.50% by weight of phosphoric acid, mono- and dihexyl esters compounded with tetramethylnonylamines and (C12-C14) alkyl amines;

k) 0.50% by weight of Phosphorothioic acid,O,O,O-triphenyl ester,tert-butyl derivatives;

l) 0.50% by weight of 2-(8-Heptadecenyl)-4,5-dihydro-1H-imidazole-1-ethanol;

m) 0.50% by weight of N-Methyl-N-(1-oxo-9-octadecenyl)glycine;

n) 0.10% by weight of N,N-Bis(2-ethylhexyl)-ar-methyl-1H-benzotriazole-1-methanamine; and o) 40 Parts Per Million (PPM) of a dimethylpolysiloxane.

Viscometrics of the sample were:

| | |
|---|---|
| Viscosity 100 degrees Celsius | 5.2 centistokes (cSt); |
| Viscosity 40 degrees Celsius | 33.1 centistokes (cSt); and |
| Viscosity Index | 78. |

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A food grade lubricant composition comprising about 90 to about 95 weight percent of an alkylated naphthalene, and the balance consisting of one or more additives each being selected from the group consisting of an effective amount of at least one antioxidant, an effective amount of at least one ferrous metal corrosion inhibitor, an effective amount of at least one anti-wear/lubricity additive, and an effective amount of at least one anti-foam agent.

2. The lubricant composition of claim 1, wherein the balance consists of:

about 0.25% to about 2.0% weight percent of an aromatic amine antioxidant;

about 0.25% to about 2.0% weight percent of a phenolic antioxidant;

about 0.05% to about 2.0% weight percent of at least one ferrous metal corrosion inhibitor;

about 0.05% to about 0.10% weight percent of a cuprous metal deactivator;

about 0.25% to about 0.50% weight percent of at least one antiwear/lubricity additive; and about 20 parts per million to about 100 parts per million of a dimethylpolysiloxane antifoam additive.

3. A method of cleaning and lubricating a compressor, comprising cleaning and lubricating the compressor with a cleaner/lubricant that is subject to incidental contact with food, wherein said compressor is continuously run for up to 1000 hours without changing out the cleaner/lubricant, and the cleaner/lubricant composition is the composition of claim 2.

4. A method of cleaning and lubricating a vacuum pump, comprising lubricating the vacuum pump with a lubricant that is subject to incidental contact with food, wherein said vacuum pump is continuously run for up to 1000 hours without changing out the lubricant, and the lubricant composition is the composition of claim 2.

5. The lubricant composition of claim 2, wherein the at least one antiwear/lubricity additive is a food-grade oil soluble compound containing at least one of sulfur and phosphorous.

6. The food grade lubricant composition of claim 1, wherein the alkylated naphthalene has a viscosity of greater than about 35 centistokes at 40° C.

7. The food grade lubricant composition of claim 1, wherein the alkylated naphthalene is a food grade alkylated naphthalene.

* * * * *